US007556539B2

(12) United States Patent
Takahashi et al.

(10) Patent No.: US 7,556,539 B2
(45) Date of Patent: Jul. 7, 2009

(54) CONNECTOR

(75) Inventors: Toshiharu Takahashi, Makinohara (JP); Kazuto Ohtaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/132,956

(22) Filed: Jun. 4, 2008

(65) Prior Publication Data

US 2008/0305694 A1 Dec. 11, 2008

(30) Foreign Application Priority Data

Jun. 5, 2007 (JP) ..... 2007-149488

(51) Int. Cl.
*H01R 13/514* (2006.01)

(52) U.S. Cl. ..... 439/752

(58) Field of Classification Search ..... 439/752, 439/488–489, 595, 352, 752.5, 357–358, 439/596, 271–273, 372, 350, 744, 912
See application file for complete search history.

(56) References Cited

U.S. PATENT DOCUMENTS 6,764,352 B2 * 7/2004 Tsuji ..... 439/752
7,044,788 B2 * 5/2006 Maeda ..... 439/595
7,140,908 B2 * 11/2006 Katsuma ..... 439/489

FOREIGN PATENT DOCUMENTS

JP 2000-268915 A 9/2000
JP 3193271 B2 5/2001

* cited by examiner

*Primary Examiner*—Edwin A. Leon
(74) *Attorney, Agent, or Firm*—Sughrue Mion, PLLC

(57) ABSTRACT

When each metal terminal 3 is completely inserted into a housing 4, the metal terminal 3 is prevented from movement in forward, upward, downward, left and right directions. The metal terminal 3 is also primarily retained by a terminal retaining member 5, and is prevented from movement in a rearward direction. Then, when the terminal retaining member 5 is pushed up, and is shifted from a provisionally-retained condition to a completely-retained condition, only the terminal retaining member 5 is moved while the metal terminals 3 remain as they are. At this time, the amount of engagement of a primarily-retained portion of the metal terminal is reduced, whereas a secondarily-retaining portion of the terminal retaining member 5 is engaged with the metal terminal 3 in accordance with an upward movement of the terminal retaining member 3, thereby securing a necessary and sufficient retaining force.

5 Claims, 14 Drawing Sheets

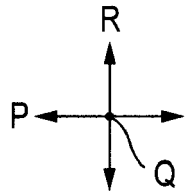
FIG. 2 (a)
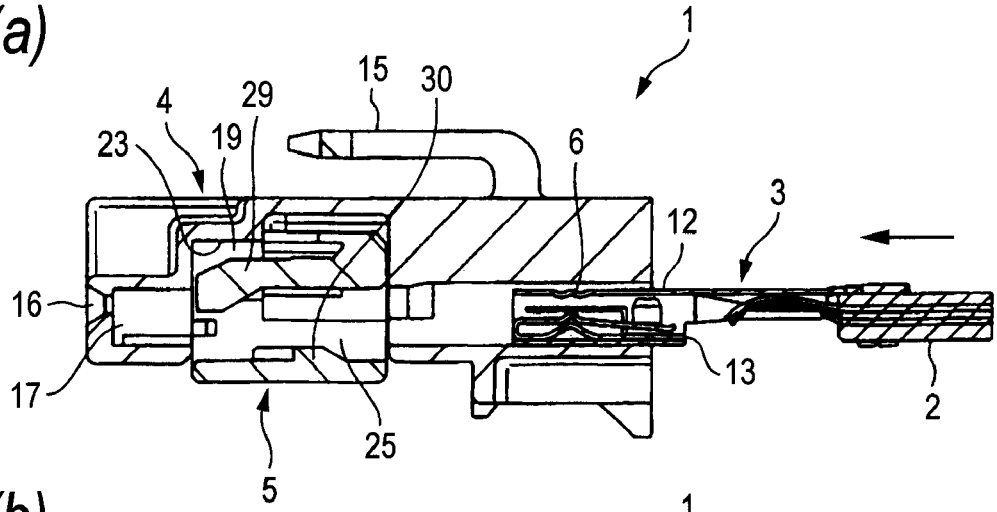
FIG. 2 (b)
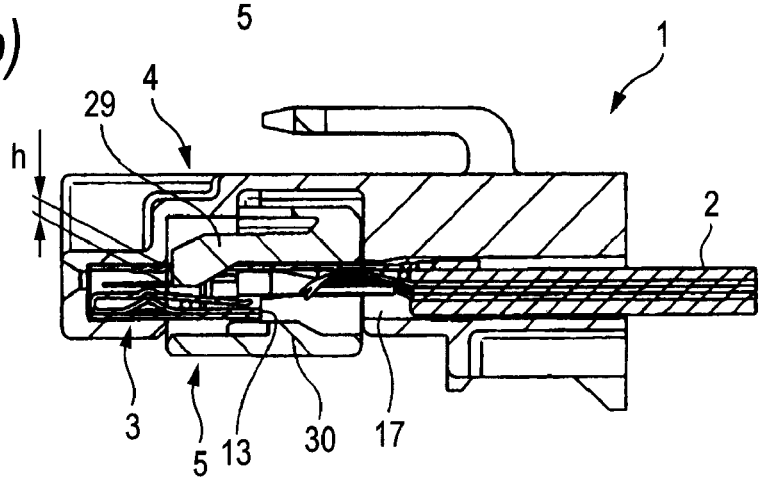
FIG. 2 (c)
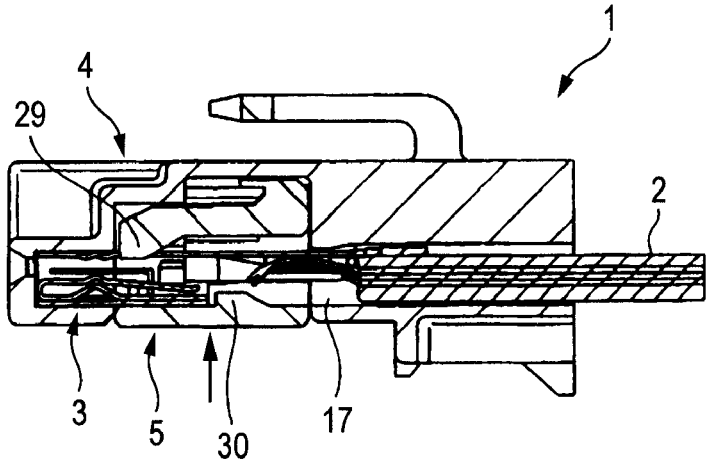

CONNECTOR

BACKGROUND OF THE INVENTION

1. Field of the Invention

This invention relates to a connector in which metal terminals are retained in a double manner, and more particularly to a connector comprising female metal terminals, a housing having terminal receiving holes and a terminal retaining member-receiving portion, and a terminal retaining member adapted to be provisionally and completely retained in the terminal retaining member-receiving portion.

2. Description of the Related Art

A connector has been used for connecting wire harnesses together or for connecting a wire harness to an electrical equipment. The connector includes a housing made of a synthetic resin, and metal terminals (connection terminals) each connected to an end portion of a wire can be received and held in this housing. When the connector is fitted to a mating connector, the metal terminals are electrically connected respectively to metal terminals of the mating connector.

The metal terminals received and held in the housing are retained in a double manner by a terminal retaining member so as not to be withdrawn from the housing. Furthermore, when the metal terminal is kept in a half-fitted condition relative to the housing, the movement of the terminal retaining member is limited so that such a half-fitted condition can be detected.

The structure relating to the double retaining of the metal terminal, as well as the structure relating to the detection of the half-fitted condition, is disclosed, for example, in the following Patent Literatures 1 and 2.

Patent Literature 1: Japanese Patent No. 3,193,271

Patent Literature 2: JP-A-2000-268915

In the conventional technique disclosed in Patent Literature 1, the metal terminal inserted in the housing is not prevented from movement in a withdrawing direction before the terminal retaining member is shifted to a completely-retained condition. Therefore, there is a fear that the metal terminal may be withdrawn from the housing (In the case of the multi-pole connector, the metal terminals often are not mounted at one time, and the terminal retaining member is kept in a provisionally-retained condition, and in this condition the assembling process shifts from one step to another. Therefore, in such a situation in which the metal terminal may be withdrawn from the housing, the manufacture of the wire harness will be adversely affected.

Furthermore, in the conventional technique disclosed in Patent Literature 1, the movement of the metal terminal in the withdrawing direction is not prevented as described above, and therefore in the case of the multi-pole connector, when the terminal retaining member is shifted from the completely-retained condition to the provisionally-retained condition, there is a fear that even those metal terminals, for example, which are not required for maintenance, may also be withdrawn from the housing (that is, the efficiency of the maintenance operation is low).

Furthermore, in the conventional technique disclose in Patent Literature 1, the metal terminal need to have several projecting portions so that it can be retained in a double manner. Therefore, there is encountered a problem that the metal terminal itself has an increased size because of the formation of these projecting portions. The increased size of the metal terminal leads to a problem that the connector is also increased in size.

On the other hand, in the conventional technique disclosed in Patent Literature 2, the metal terminal is inserted into the housing, and is primarily retained by the terminal retaining member. Thereafter, the metal terminal is pushed up by the terminal retaining member, so that the metal terminal is secondarily retained by the housing. Therefore, the housing need to have a sufficiently large space to receive the metal terminals, and a relatively large clearance is formed between the metal terminal and a terminal receiving hole. This clearance may invite a disadvantage that the metal terminal may be inclined, and if the metal terminal is thus inclined, a retaining force provided by the primary retaining is lowered. When withdrawing such inclined metal terminal from the housing, for example, for maintenance purposes, there is encountered a problem that the inclined metal terminal is caught by the housing, and therefore can not be withdrawn from the housing.

Furthermore, in the conventional technique disclosed in Patent Literature 2, the housing need to have the large space for receiving the metal terminals as described above, and therefore there is encountered a problem that the connector is increased in size.

Furthermore, in the conventional technique disclosed in Patent Literature 2, the connector is constructed such that the metal terminal is pushed up by the terminal retaining member as described above, and therefore in the case of the multi-pole connector, all of the metal terminals must be pushed up at one time, and therefore there is encountered a problem that the efficiency of the assembling operation is adversely affected.

SUMMARY OF THE INVENTION

This invention has been made in view of the above circumstances, and an object of the invention is to provide a connector in which the efficiency of an assembling operation, the efficiency of a maintenance operation, etc., are enhanced, and also a sufficient retaining force can be secured with a compact design, and further a half-inserted condition of a metal terminal can be detected. Another object is to provide a connector in which only a necessary metal terminal can be easily removed.

The above object has been achieved by a connector of the first aspect of the invention characterized in that the connector comprises a female metal terminal having a box-like portion, a housing including a terminal receiving hole and a terminal retaining member-receiving portion, and a terminal retaining member which can be provisionally and completely retained in the terminal retaining member-receiving portion; and the box-like portion of the metal terminal has a lance hole formed in a wall thereof opposed to an upper surface of the terminal receiving hole, and an end portion of the box-like portion including a rear end of a wall thereof opposed to a lower surface of the terminal receiving hole serves as a terminal-side retaining portion; and the terminal receiving hole of the housing extends from a rear end of the housing toward a front end of the housing, and is so sized as to prevent the metal terminal, received in the terminal receiving hole, from movement in forward, upward, downward, left and right directions; and the terminal retaining member-receiving portion of the housing is open to a lower surface of the housing, and communicates with the terminal receiving hole, and extends to the vicinity of an upper surface of the housing or extends through the upper surface of the housing; and the terminal retaining member includes a retaining member-side terminal receiving hole formed therethrough in the forward-rearward direction and communicating with the terminal receiving hole, a terminal primarily-retaining arm of an elastic nature formed at an upper side of the retaining member-side terminal receiving hole, and a terminal secondarily-retaining projection formed at a lower side of the retaining member-side terminal receiving hole; and when the terminal retaining member is disposed in the provisionally-retained condition relative to the housing, a retaining portion of the terminal primarily-retaining arm of the terminal retaining member is inserted deep in the lance hole of the metal terminal;

when the terminal retaining member is moved upward into the completely-retained condition relative to the housing, the amount of engagement of the retaining portion of the terminal primarily-retaining arm with the metal terminal is reduced in accordance with the upward movement of the terminal retaining member, whereas the terminal secondarily-retaining projection is engaged with the terminal-side retaining portion of the metal terminal; and when trying to shift the terminal retaining member into the completely-retained condition in a half-inserted condition of the metal terminal, the terminal secondarily-retaining projection of the terminal retaining member abuts against the wall of the box-like portion of the metal terminal, thereby preventing the upward movement of the terminal retaining member.

The connector of second aspect of the invention is characterized in that in the half-inserted condition of the metal terminal, the terminal primarily-retaining arm of the terminal retaining member is disposed on the box-like portion of the metal terminal, and is elastically deformed, and in this condition, when trying to shift the terminal retaining member into the completely-retained condition, the terminal primarily-retaining arm abuts against a stopper portion of the housing, thereby preventing the upward movement of the terminal retaining member.

The connector of the third aspect of the invention is characterized in that the housing has a jig insertion port communicating with that portion of the terminal retaining member-receiving portion which is disposed closer to the upper surface of the housing than the terminal receiving hole, and when the terminal primarily-retaining arm of the terminal retaining member is pressed by a retained-condition cancellation jig inserted in the jig insertion port, the retaining arm is elastically deformed upwardly, and is brought out of retaining engagement with the metal terminal in the provisionally-retained condition of the terminal retaining member.

The connector of the fourth aspect of the invention is characterized in that the terminal retaining member has a partition wall so formed as to correspond to the terminal receiving hole of the housing, and the terminal primarily-retaining arm has a retained-condition cancellation projection which projects into a space formed as a result of formation of a notched portion in the partition wall.

The connector of fifth aspect of the invention is characterized in that the retained-condition cancellation projection has a slanting surface, and when a rearward force is applied to the slanting surface, the terminal primarily-retaining arm is elastically deformed upwardly.

In the present invention having the above features, when the metal terminal connected to an end portion of a wire is inserted into the terminal receiving hole of the housing, the metal terminal is prevented from movement in the forward, upward, downward, left and right directions because of the configuration of the terminal receiving hole. In order to prevent the movement of the metal terminal in the forward, upward, downward, left and right directions, the terminal receiving hole is formed into such size and shape that the box-like portion of the metal terminal can be snugly fitted in the terminal receiving hole. The rearward movement of the metal terminal is prevented by the terminal primarily-retaining arm of the terminal retaining member held in the provisionally-retained condition relative to the housing. In the provisionally-retained condition of the terminal retaining member, the metal terminal is held in the immovable condition. When the terminal retaining member is shifted to the completely-retained condition relative to the housing, only the terminal retaining member is moved upward while the metal terminal held in the immovable condition remains as it is. When the terminal retaining member is shifted from the provisionally-retained condition to the completely-retained condition, only the terminal retaining member is moved while the metal terminal is not moved, and therefore the pushing-up of the terminal retaining member can be easily effected.

When the terminal retaining member is moved from the provisionally-retained condition to the completely-retained condition, the amount of engagement of the retaining portion of the terminal primarily-retaining arm with the metal terminal is reduced, whereas the terminal secondarily-retaining projection disposed at that side of the metal terminal facing away from the terminal primarily-retaining arm is engaged with the terminal-side retaining portion of the metal terminal. The amount of engagement of the terminal secondarily-retaining projection with the metal terminal is equal to the amount of movement of the terminal retaining member, and also corresponds to a decrease in the amount of engagement of the terminal primarily-retaining arm, and therefore a sufficient retaining force for retaining the metal terminal is secured.

The terminal receiving hole prevents the metal terminal from movement in the upward and downward directions, and therefore even when trying to shift the terminal retaining member from the provisionally-retained condition to the completely-retained condition in a half-inserted condition of the metal terminal, the terminal secondarily-retaining projection abuts against the lower wall of the box-like portion of the metal terminal, thereby preventing the pushing-up of the terminal retaining member. Because of the fact that the terminal retaining member can not be pushed up, the half-inserted condition of the metal terminal is detected.

With respect to the detection of the half-fitted condition of the metal terminal, in the half-fitted condition of the metal terminal, the terminal primarily-retaining arm of the terminal retaining member is disposed on the box-like portion of the metal terminal, and is elastically deformed. When trying to shift the terminal retaining member from the provisionally-retained condition into the completely-retained condition in an elastically-deformed condition of the terminal primarily-retaining arm, the terminal primarily-retaining arm abuts against the stopper portion of the housing, so that the terminal retaining member is prevented from being pushed up. In this case, also, the half-fitted condition of the metal terminal can be detected.

The cancellation of the retaining of the metal terminal in the provisionally-retained condition of the terminal retaining member, as well as the retained-condition cancellation projection of the terminal primarily-retaining arm, will hereafter be described in Section "Best Mode for Carrying Out the Invention".

In the present invention recited in the first aspect of the invention, advantageously, there can be provided the connector in which the efficiency of the assembling operation, etc., can be enhanced, and also the sufficient retaining force is secured with the compact design, and further a half-inserted condition of the metal terminal can be detected. In the second aspect of the invention, there is achieved an advantage that the half-fitted condition of the metal terminal can also be detected by the elastic deformation of the terminal primarily-retaining arm.

In the third to fifth aspects of the invention, advantageously, there is provided the structure in which only the necessary metal terminal can be easily removed. Therefore, there is achieved an advantage that the efficiency of a maintenance operation is enhanced as compared with conventional connectors.

In the third aspect of the invention, the jig insertion port is provided at other portion of the housing than an insertion portion into which a metal terminal of a mating connector is adapted to be inserted, and with this construction there is achieved an advantage that the metal terminal is prevented from being damaged by the jig. In the fourth aspect of the invention, there is achieved an advantage that the terminal primarily-retaining arm, although having the retained-condition cancellation structure, can secure the sufficient retaining force. In the fifth aspect of the invention, the terminal primarily-retaining arm has the slanting surface formed on the retained-condition cancellation projection, and therefore there is achieved an advantage that the retained condition of the metal terminal can be easily effected.

BRIEF DESCRIPTION OF THE DRAWINGS

FIGS. 2A to 2C are views explanatory of double retaining of the connector, and FIG. 2A is a cross-sectional view showing a condition before a metal terminal is retained by a terminal primarily-retaining arm in a provisionally-retained condition of a terminal retaining member, and FIG. 2B is a cross-sectional view showing a condition in which the metal terminal is retained by the terminal primarily-retaining arm, and FIG. 2C is a cross-sectional view showing a condition in which the terminal retaining member is shifted to a completely-retained condition, and the metal terminal is retained by the terminal primarily-retaining arm and a terminal secondarily-retaining projection.

DESCRIPTION OF THE PREFERRED EMBODIMENTS

Figure 1:
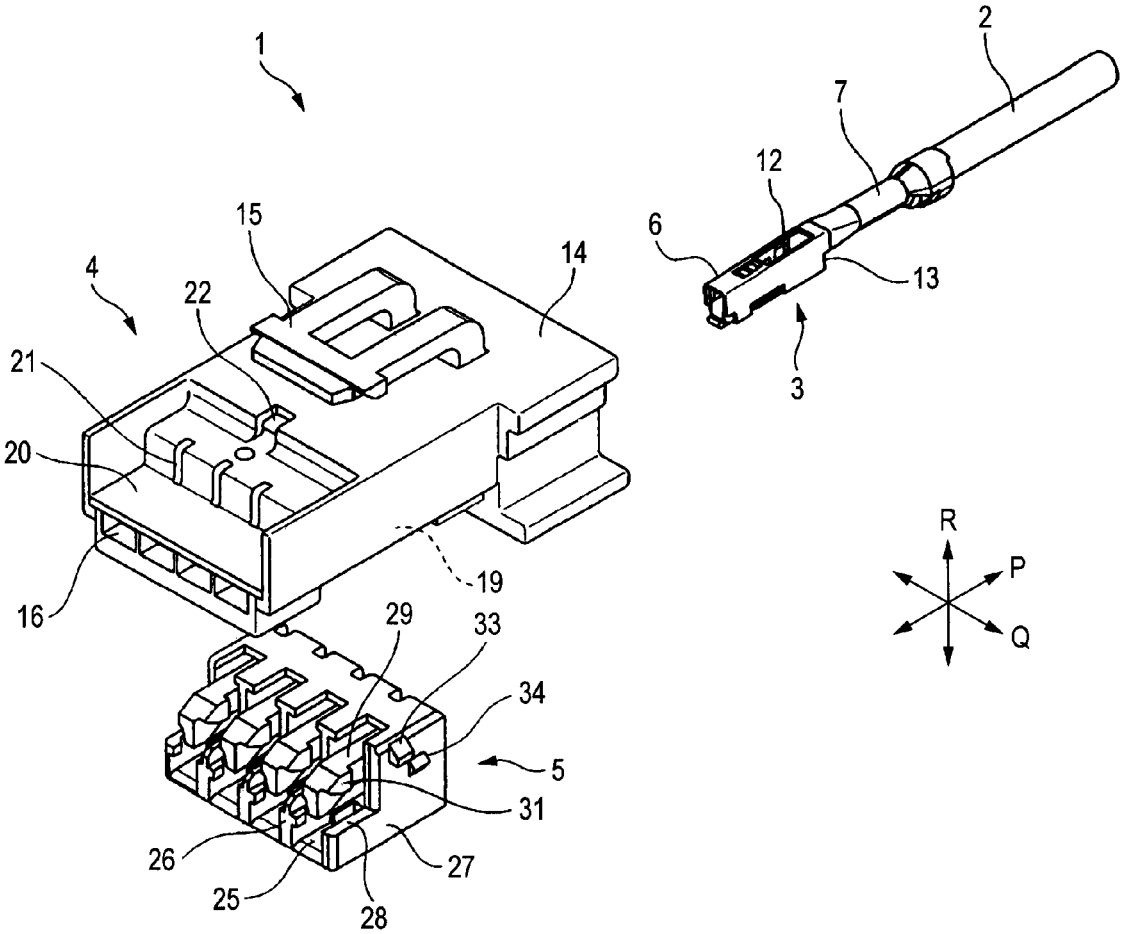
FIG. 1 is an exploded perspective view showing one preferred embodiment of a connector of the invention.

The present invention will now be described with reference to the drawings. FIG. 1 is an exploded perspective view showing one preferred embodiment of a connector of the invention. FIGS. 2A to 2C are views explanatory of double retaining of the connector, and FIG. 2A is a cross-sectional view showing a condition before a metal terminal is retained by a terminal primarily-retaining arm in a provisionally-retained condition of a terminal retaining member, and FIG. 2B is a cross-sectional view showing a condition in which the metal terminal is retained by the terminal primarily-retaining arm, and FIG. 2C is a cross-sectional view showing a condition in which the terminal retaining member is shifted to a completely-retained condition, and the metal terminal is retained by the terminal primarily-retaining arm and a terminal secondarily-retaining projection.

In FIGS. 1 and 2, a forward-rearward direction is indicated by arrow P, a left-right direction is indicated by arrow Q, and an upward-downward direction is indicated by arrow R (These definitions are also applied to the other Figures.).

In FIG. 1, reference numeral 1 denotes the connector of the invention. This connector 1 comprises female metal terminals 3 (four metal terminals in this embodiment although not particularly shown. This number is merely one example.) connected respectively to end portions of wires 2 forming a wire harness, a housing 4 for receiving the metal terminals 3, and the terminal retaining member 5 which can be fitted in the housing 4 so as to be disposed in the provisionally-retained condition and the completely-retained condition. The connector 1 has a structure (terminal double retaining structure) by which the plurality of metal terminals 3 received in the housing 4 are retained in a double manner with the use of the terminal retaining member 5.

The terminal double retaining structure will be briefly described. First, the terminal retaining member 5 is fitted into the housing 4 in provisionally-retained relation thereto as shown in FIG. 2A, and then each metal terminal 3 is inserted into the housing 4 from a rear end thereof. When the metal terminal 3 is completely inserted into the housing 4, the metal terminal 3 is prevented from movement in the forward, upward, downward, left and right directions. Also, the metal terminal 3 is primarily retained by the terminal retaining member 5, and is prevented from movement in the rearward direction (see FIG. 2B).

Then, when the terminal retaining member 5 is pushed upward, and is shifted from the provisionally-retained condition to the completely-retained condition as shown in FIG. 2C, only the terminal retaining member 5 is moved while the metal terminals 3 remain as they are. At this time, the amount of engagement of a primarily-retained portion of each metal terminal 3 is reduced, whereas a secondarily-retaining portion of the terminal retaining member 5 is engaged with the metal terminal 3 (to achieve the secondary retaining) in accordance with the upward movement of the terminal retaining member 5, so that a necessary and sufficient retaining force is secured. The metal terminals 3 are retained in a double manner by the terminal retaining member 5 held in the completely-retained condition relative to the housing 4, and are prevented from withdrawal from the housing 4.

Figure 3:
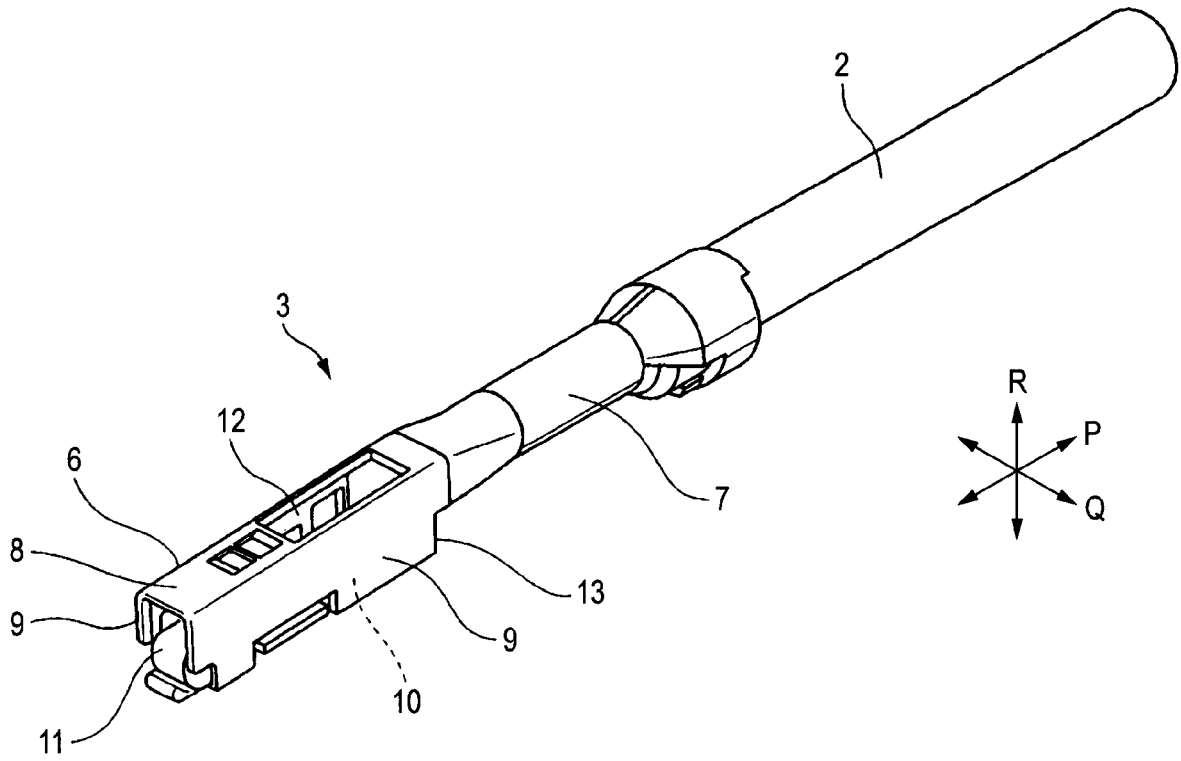
FIG. 3 is a perspective view of the metal terminal.
Figure 4:
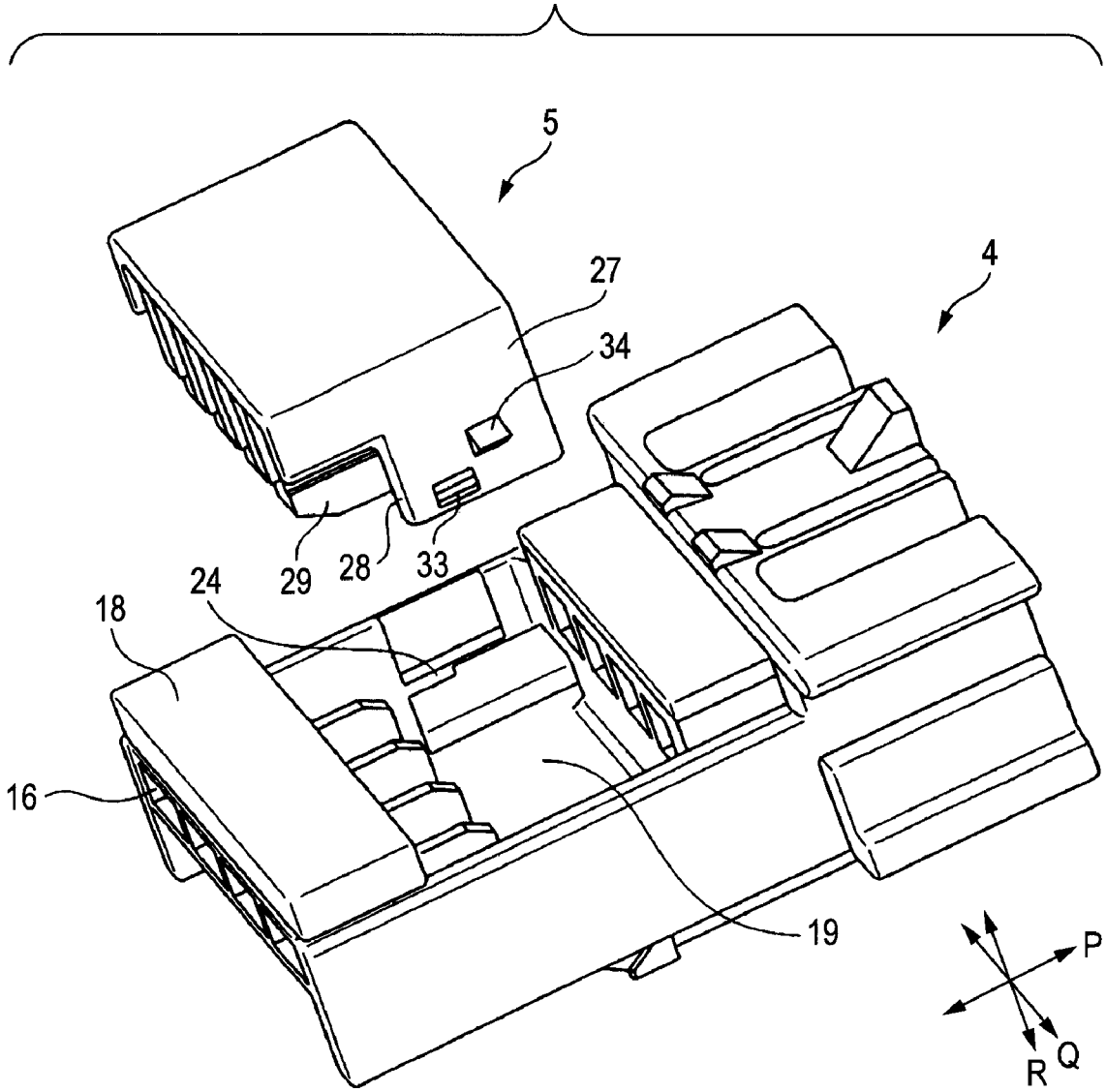
FIG. 4 is a perspective view showing the connector and the terminal retaining member.
Figure 5:
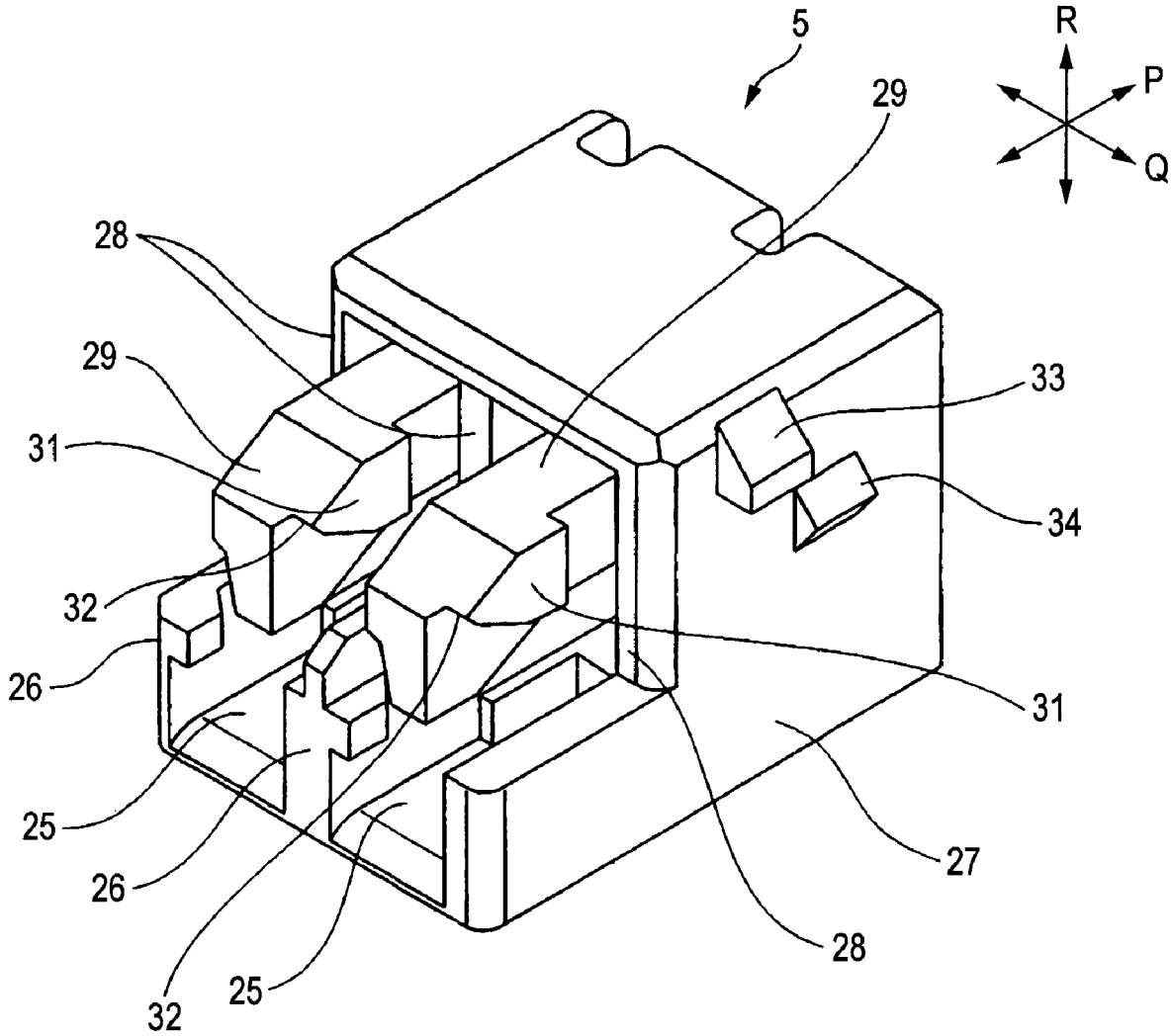
FIG. 5 is an enlarged view of an important portion of the terminal retaining member.
Figure 6:
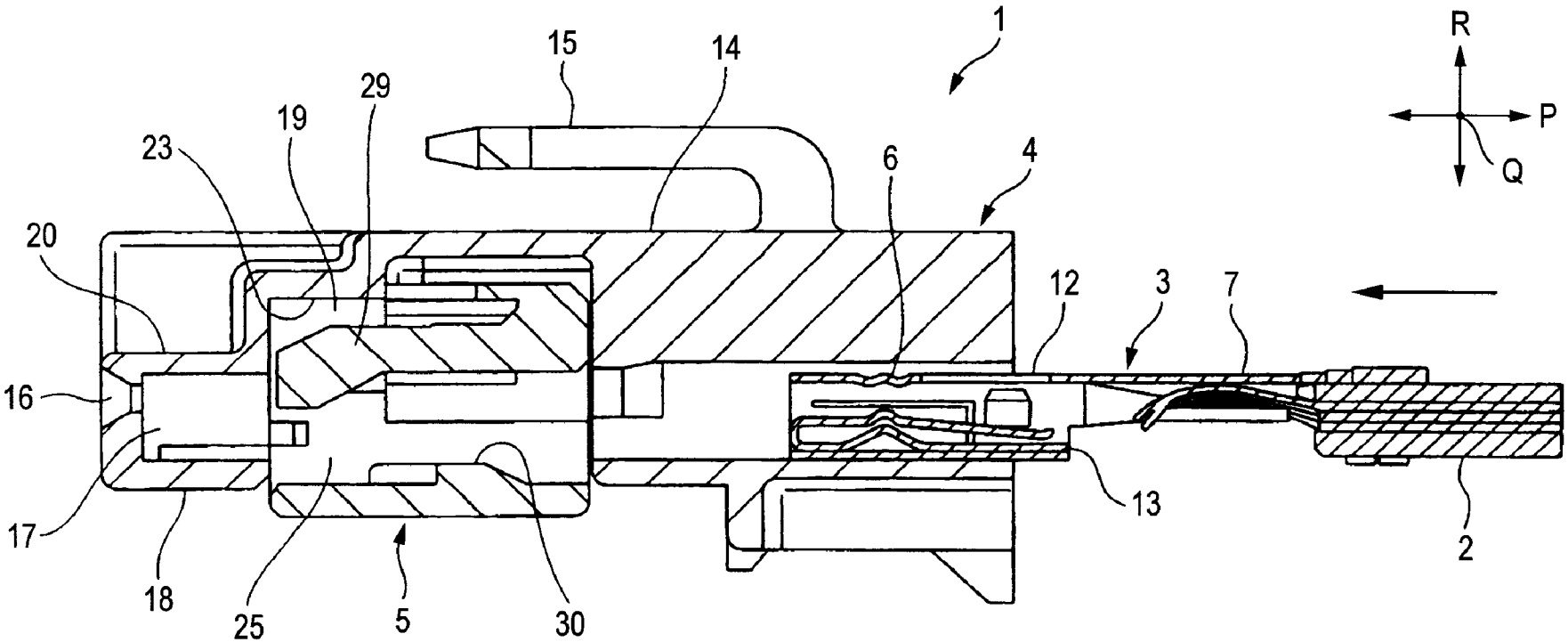
FIG. 6 is a cross-sectional view showing the condition before the metal terminal is retained by the terminal primarily-retaining arm in the provisionally-retained condition of the terminal retaining member.
Figure 7:
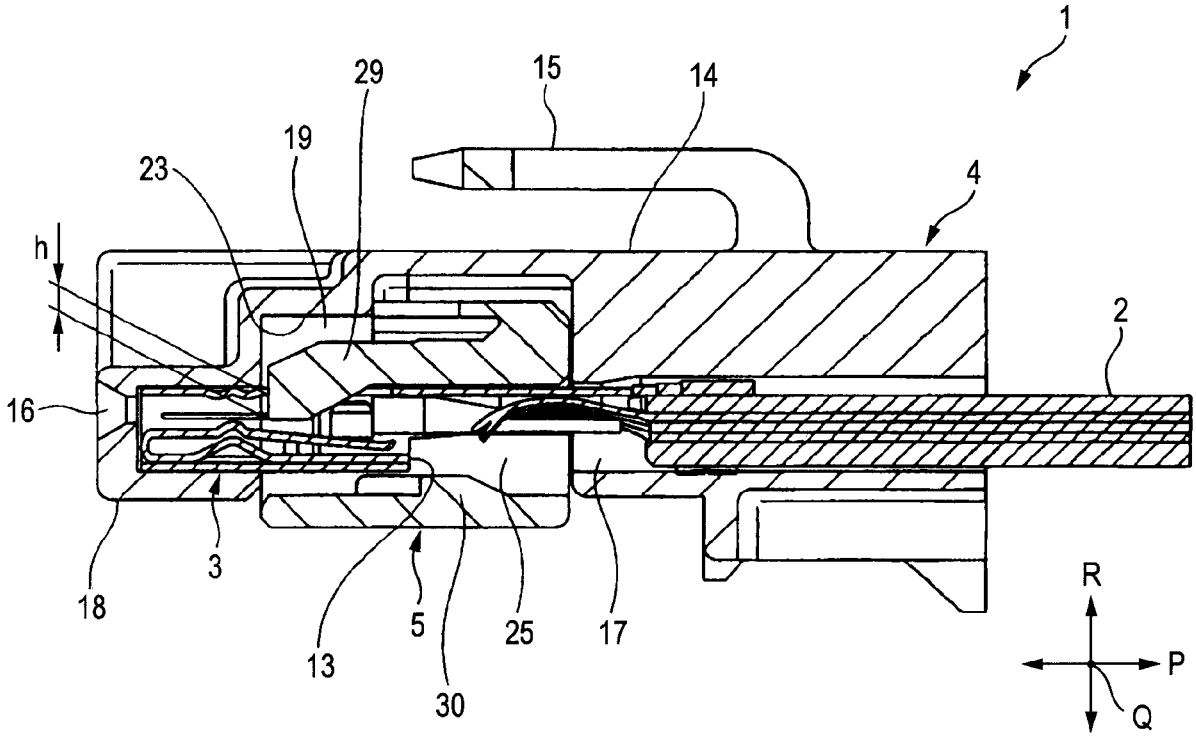
FIG. 7 is a cross-sectional view showing the condition in which the metal terminal is retained by the terminal primarily-retaining arm.
Figure 8:
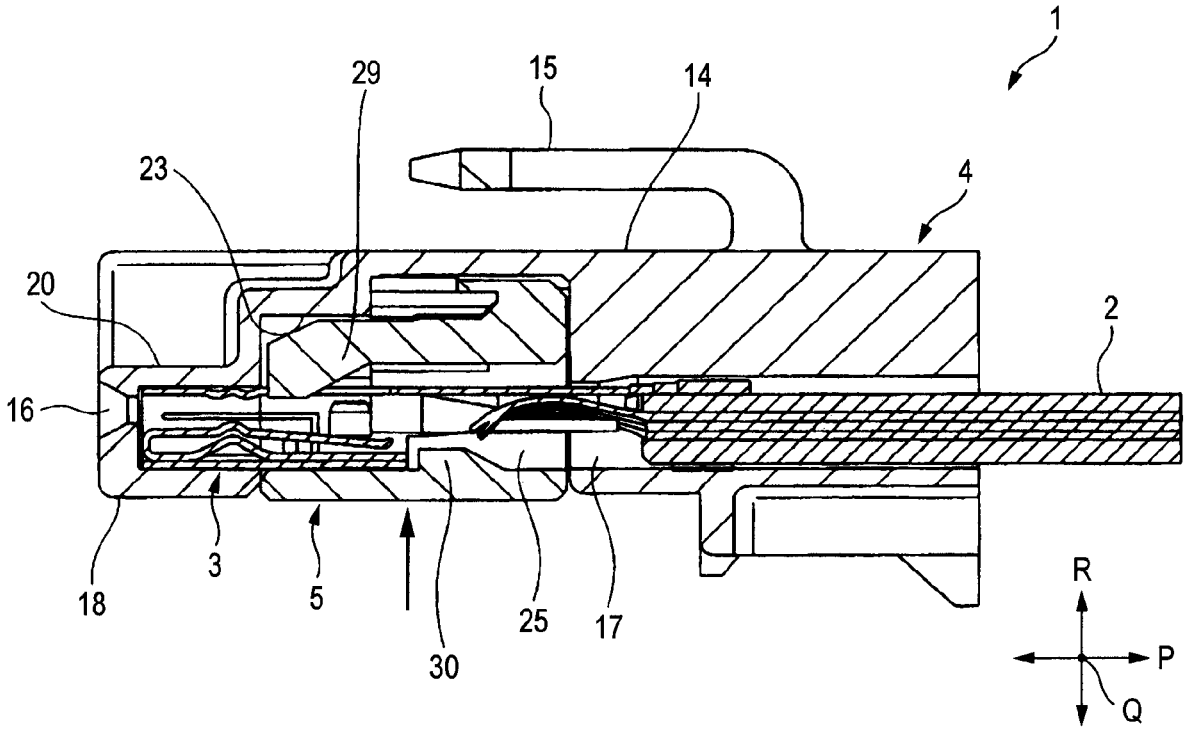
FIG. 8 is a cross-sectional view showing the condition in which the terminal retaining member is shifted to the completely-retained condition, and the metal terminal is retained by the terminal primarily-retaining arm and the terminal secondarily-retaining projection.
Figure 9:
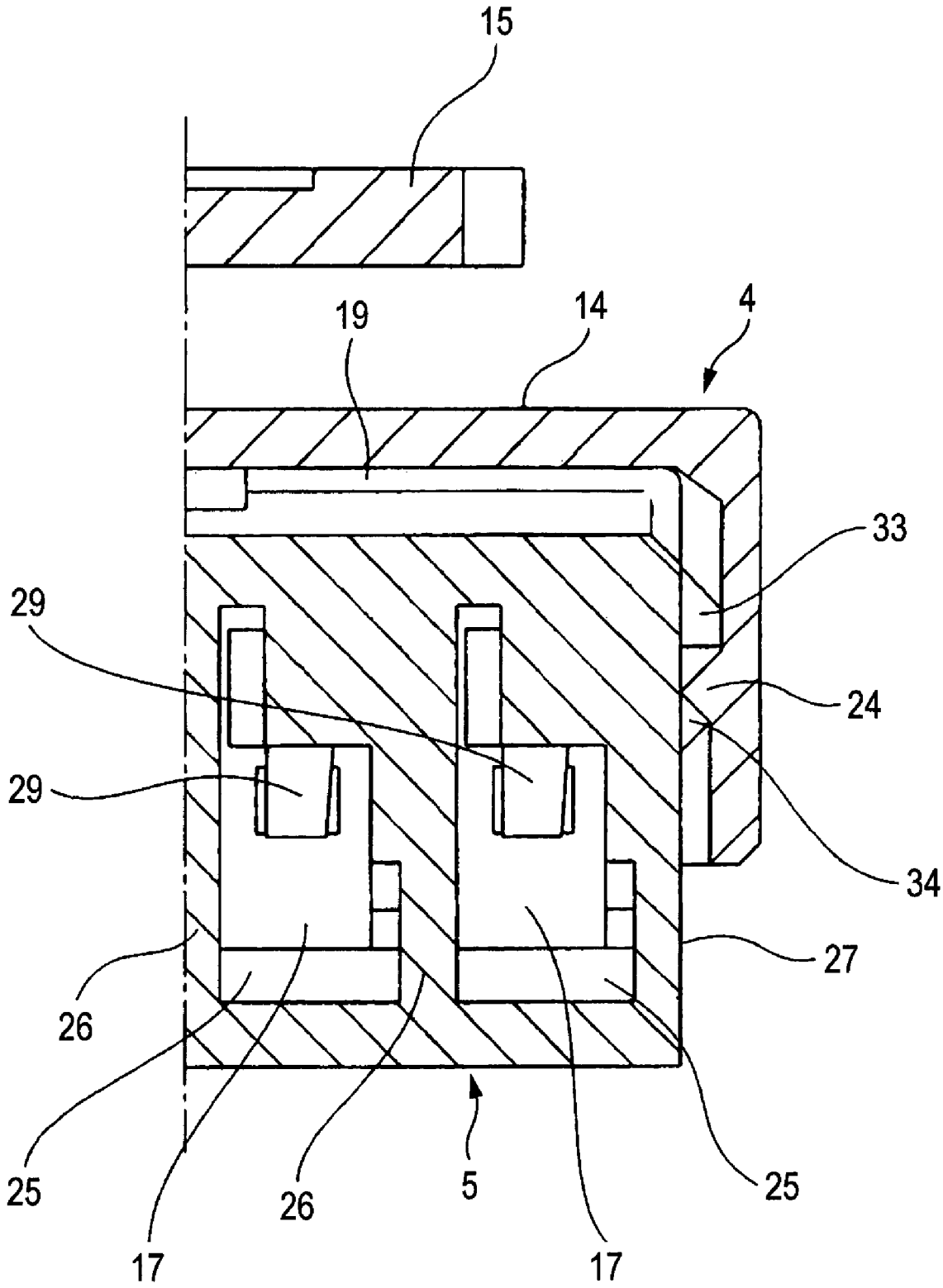
FIG. 9 is a cross-sectional view showing the provisionally-retained condition of the terminal retaining member.
Figure 10:
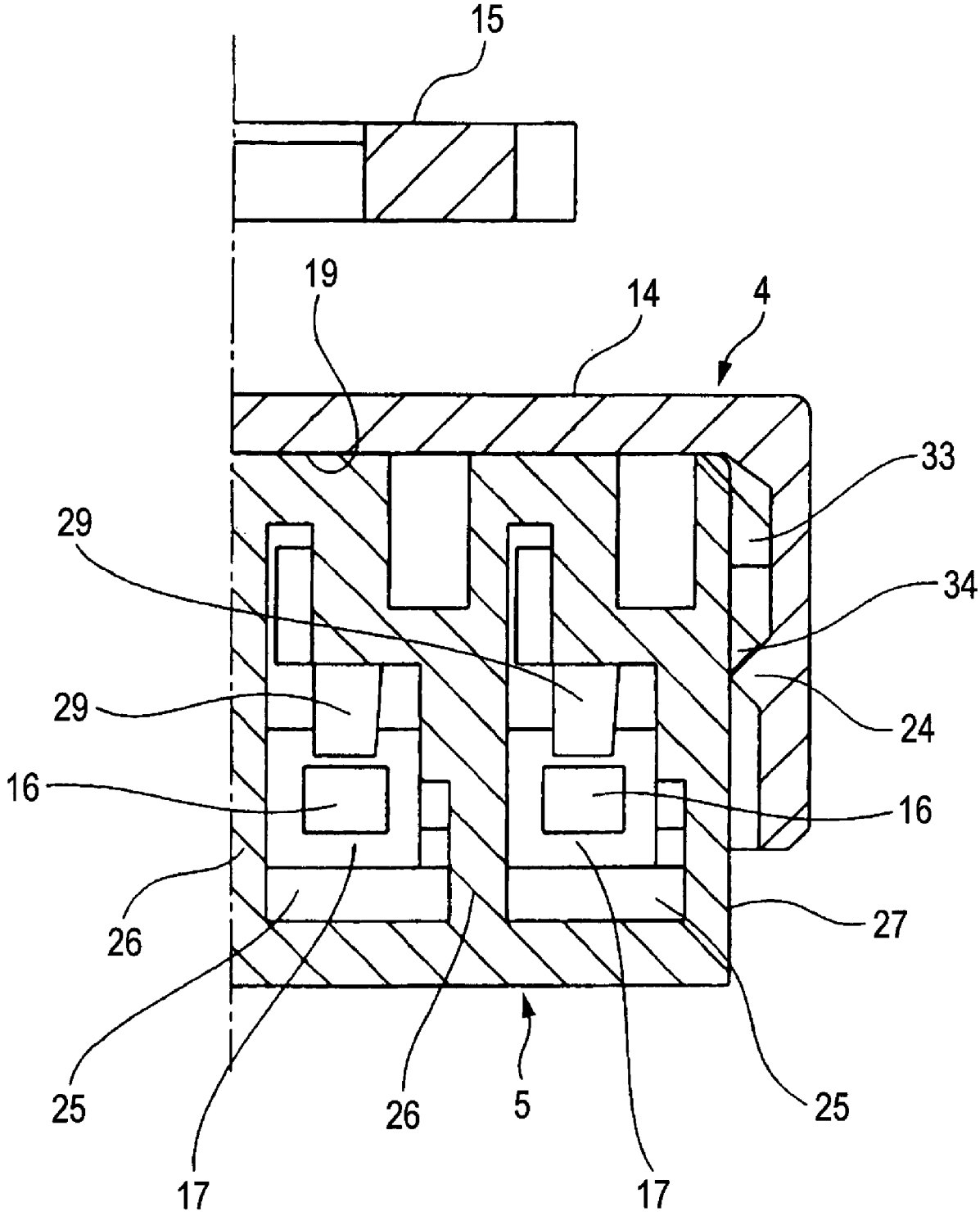
FIG. 10 is a cross-sectional view showing the completely-retained condition of the terminal retaining member.
Figure 11:
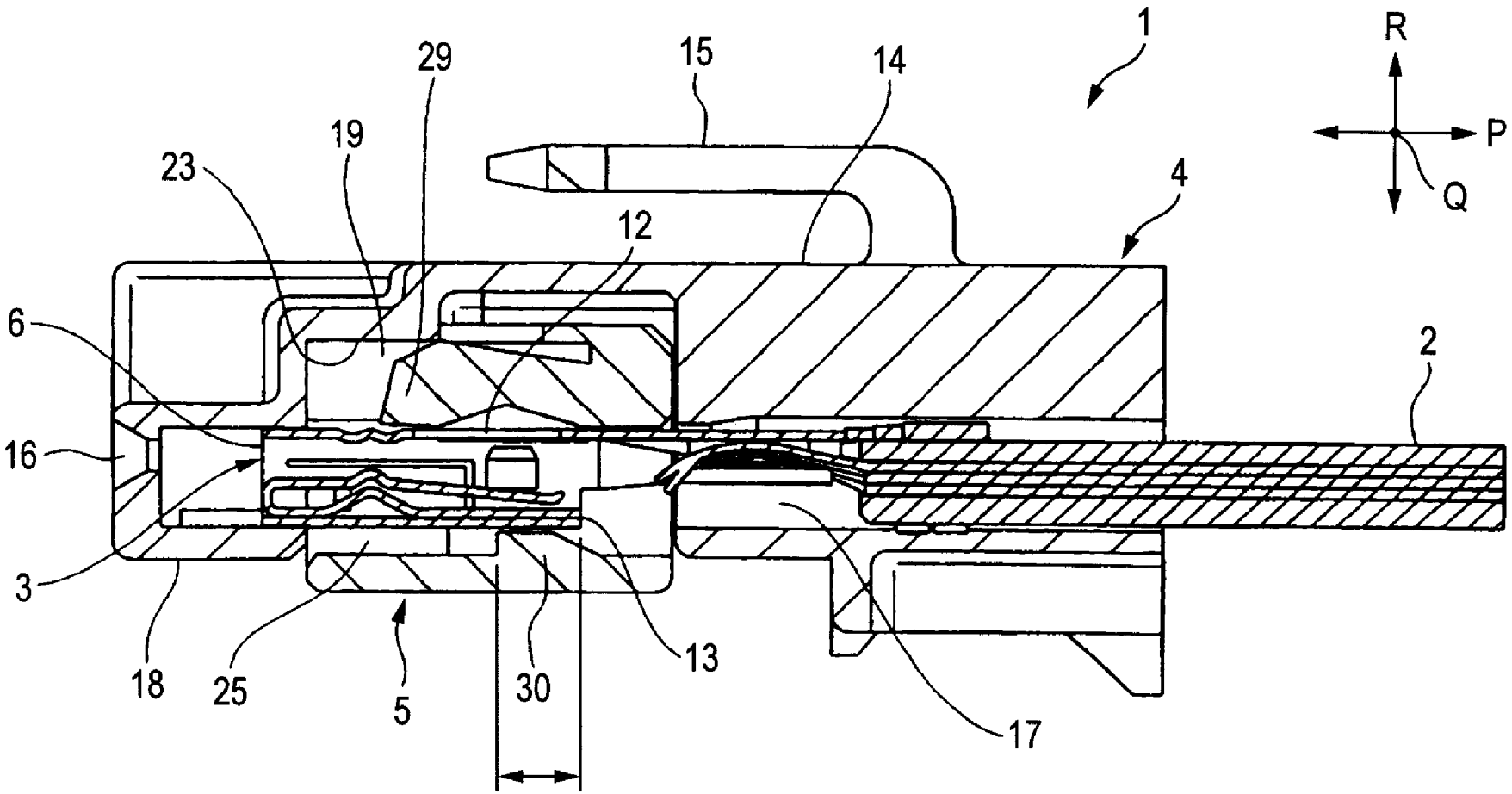
FIG. 11 is a cross-sectional view showing the detection of a half-inserted condition of the metal terminal.
Figure 12:
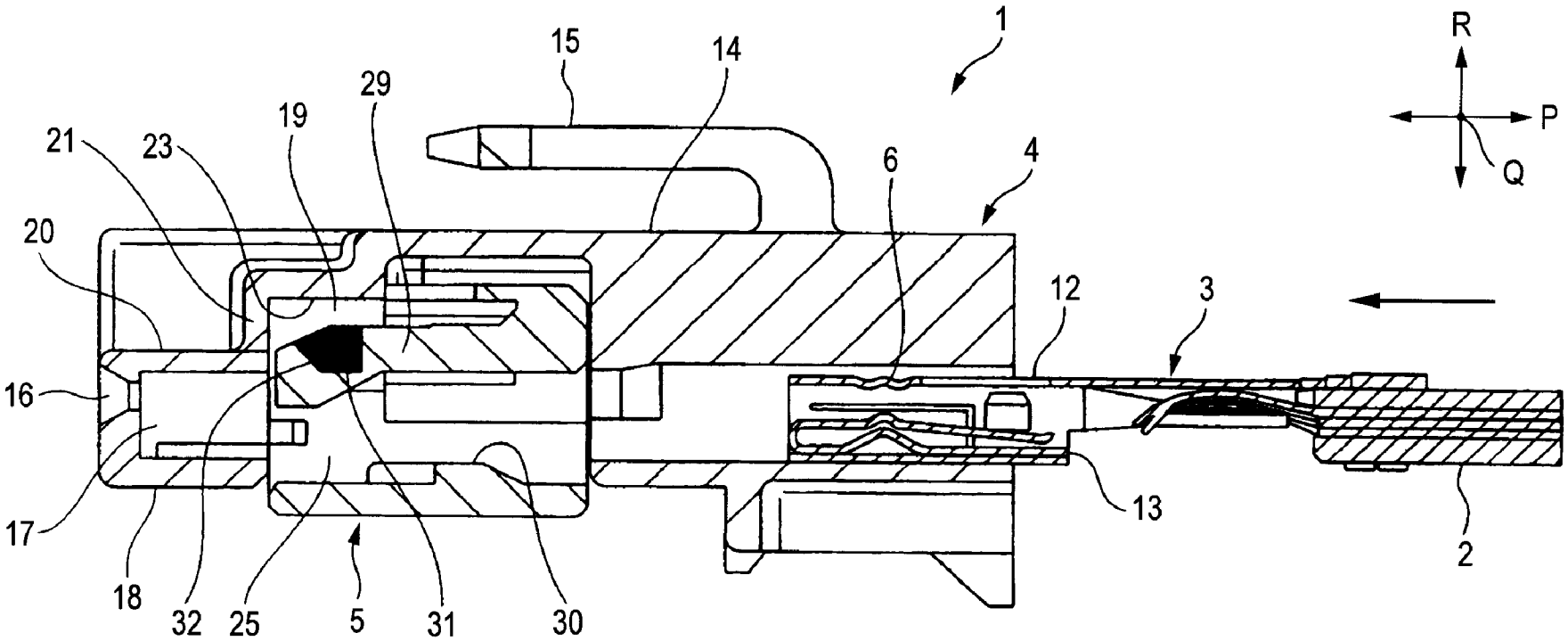
FIG. 12 is a view similar to FIG. 6, but showing a retained-condition cancellation projection.
Figure 13:
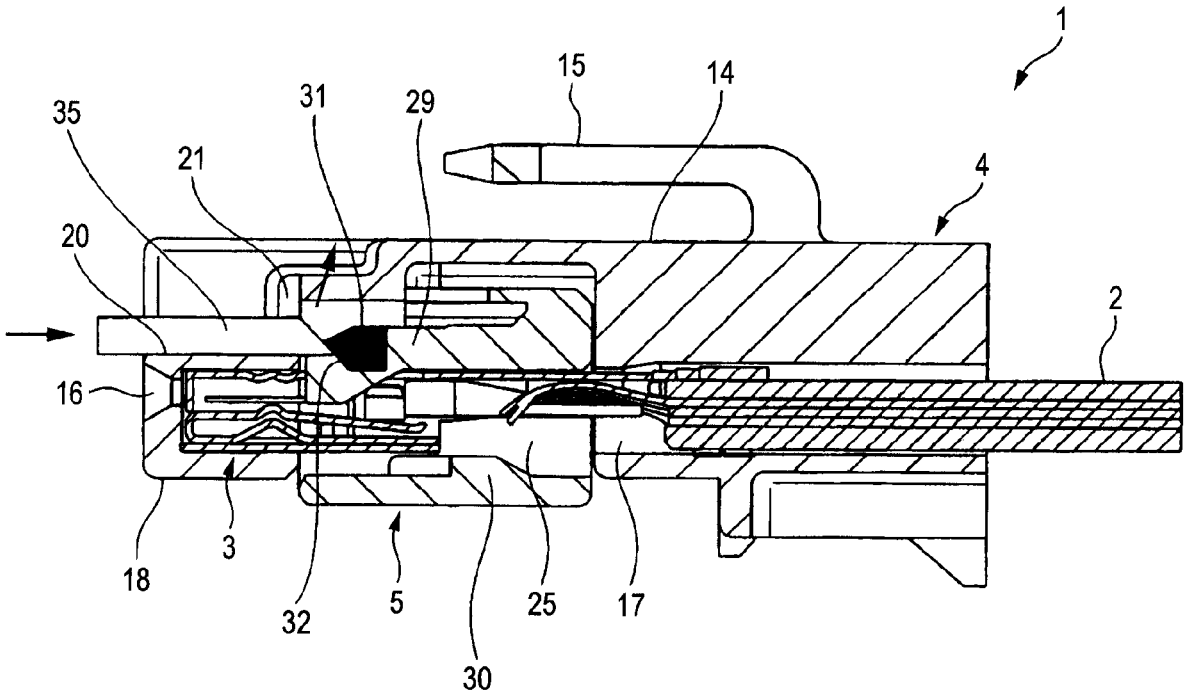
FIG. 13 is a cross-sectional view showing a condition in which the retaining of the metal terminal is to be canceled, using the retained-condition cancellation projection.
Figure 14:
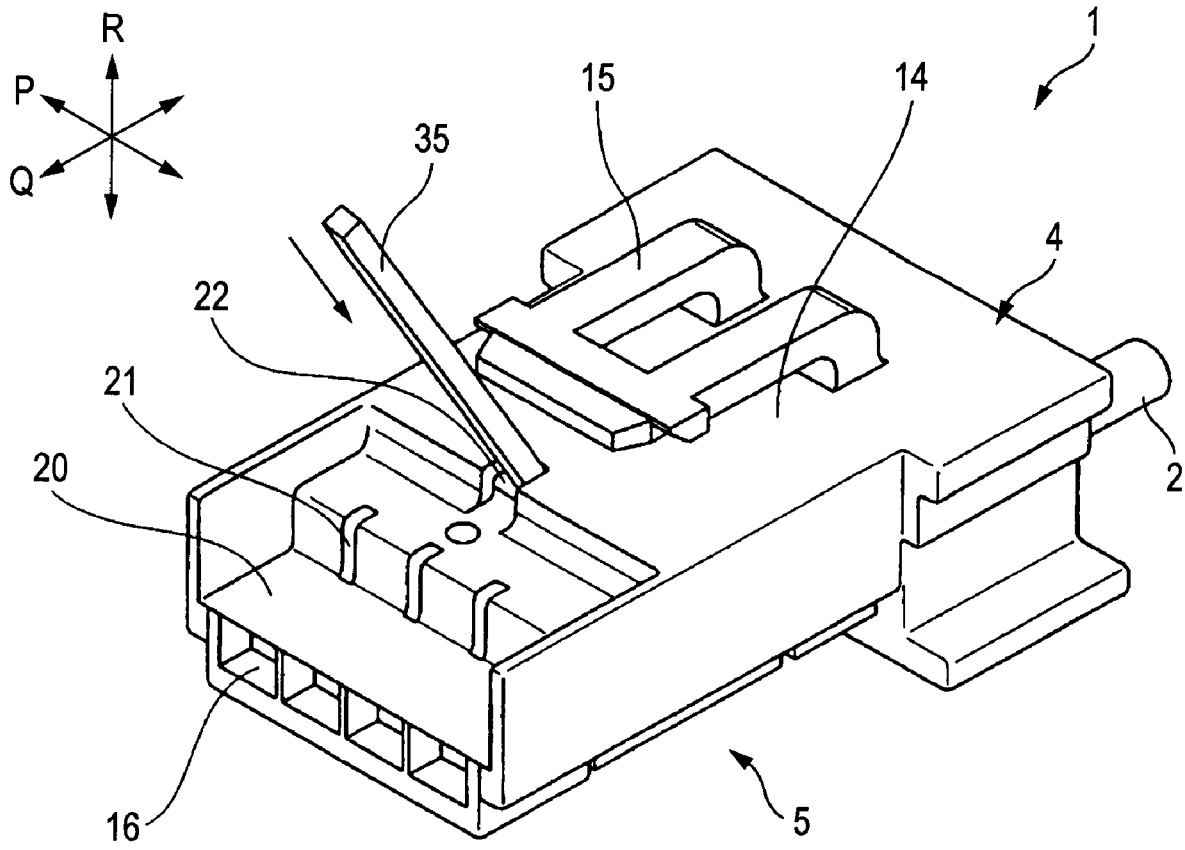
FIG. 14 is a perspective view showing a condition in which the terminal retaining member is to be shifted from the completely-retained condition to the provisionally-retained condition.

Each of the above constituent members will be described below. FIG. 3 is a perspective view of the metal terminal 3, FIG. 4 is a perspective view showing the connector and the terminal retaining member, FIG. 5 is an enlarged view of an important portion of the terminal retaining member, FIG. 6 is a cross-sectional view showing the condition before the metal terminal is retained by the terminal primarily-retaining arm in the provisionally-retained condition of the terminal retaining member, FIG. 7 is a cross-sectional view showing the condition in which the metal terminal is retained by the terminal primarily-retaining arm, FIG. 8 is a cross-sectional view showing the condition in which the terminal retaining member is shifted to the completely-retained condition, and the metal terminal is retained by the terminal primarily-retaining arm and the terminal secondarily-retaining projection, FIG. 9 is a cross-sectional view showing the provisionally-retained condition of the terminal retaining member, FIG. 10 is a cross-sectional view showing the completely-retained condition of the terminal retaining member, FIG. 11 is a cross-sectional view showing the detection of a half-inserted condition of the metal terminal, FIG. 12 is a view similar to FIG. 6, but showing a retained-condition cancellation projection, FIG. 13 is a cross-sectional view showing a condition in which the retaining of the metal terminal is to be canceled, using the retained-condition cancellation projection, and FIG. 14 is a perspective view showing a condition in which the terminal retaining member is to be shifted from the completely-retained condition to the provisionally-retained condition.

In FIG. 3, the metal terminal 3 is a female connection terminal formed by processing an electrically-conductive metal sheet into a predetermined shape as shown in the drawings. The metal terminal 3 includes a box-like portion 6 serving as an electrical contact portion, and a wire connection portion 7. The box-like portion 6 is of such a structure that when a tab-like electrical contact portion of a male metal terminal of a mating connector (not shown) is inserted into the box-like portion 6, the box-like portion 6 is electrically connected to this tab-like electrical contact portion. More specifically, the box-like portion 6 of the illustrated example includes an upper wall 8, a pair of left and right side walls 9 and 9, and a lower wall 10. An opening is formed in a front face of the box-like portion 6, and the male metal terminal is adapted to be inserted into this opening. A resilient contact piece portion 11 is provided within the box-like portion 6. With respect to the shape of the box-like portion 6, its front face has a generally square shape. each of the upper wall 8, side walls 9 and 9 and lower wall 10 has a rectangular shape elongated in the forward-rearward direction.

A lance hole 12 is formed through the upper wall 8 of the box-like portion 6. An end portion of the box-like portion 6 including a rear end of the lower wall 10 serves as a terminal-side retaining portion 13. The lance hole 12 is mainly used for the primary retaining in the above double retaining, and the terminal-side retaining portion 13 is used for the secondary retaining in the double retaining. The wire connection portion 7 has an ordinary structure, and includes a conductor press-clamping portion, and a sheath press-clamping portion.

In FIGS. 1, 4, 6 and 14, the housing 4 is molded of an insulative synthetic resin material. The housing 4 is so shaped as to be inserted and fitted into a housing of the mating connector (not shown). A lock arm 15 for retaining or locking engagement with the housing of the mating connector (not shown) is formed on an upper surface 14 of the housing 14. A plurality of male terminal insertion ports 16 are formed in a front surface of the housing 4, and the male metal terminals of the mating connector (not shown) can be inserted respectively into these insertion ports 16.

The housing 4 further includes terminal receiving holes 17 formed therein. The housing 4 further includes a terminal retaining member-receiving portion 19 open to a lower surface 18 of the housing 4. The upper surface 14 of the housing 4 is stepped at a front portion thereof as shown in the drawings. A jig guide surface 20, a plurality of jig insertion ports 21 and one jig insertion port 22 (which will hereafter more fully described) are formed at this stepped portion.

The terminal receiving holes 17 are adapted to respectively receive the metal terminals 3, and each terminal receiving hole 17 is formed such that its upper surface, lower surface and left and right side surfaces extend straight from the rear end of the housing 4 to the front end thereof (The terminal receiving hole 17 is slightly stepped at its intermediate portion so as to suitably receive a connected portion between the wire 2 and the metal terminal 3). An abutment surface for limiting the forward movement of the metal terminal 3 is formed at the front end of the terminal receiving hole 17. The male terminal insertion port 16 communicates with the front end of the terminal receiving hole 17. The terminal receiving hole 17 is formed into a shape corresponding to the shape of the box-like portion 6 of the metal terminal 3. The terminal receiving hole 17 is formed into such a shape that when the metal terminal 3 is inserted to reach the front end of the terminal receiving hole 17, the terminal receiving hole 17 prevents the metal terminal 3 from movement in the forward, upward, downward, left and right directions. The terminal receiving hole 17 is formed into such a shape that an unnecessary clearance will not be formed between the inner periphery of the terminal receiving hole 17 and the outer periphery of the box-like portion 6 of the metal terminal 3. In this embodiment, there are provided the plurality of (four) terminal receiving holes 17 arranged in a row in the left-right direction, and any two adjacent terminal receiving holes 17 are separated from each other by a partition wall.

The terminal retaining member-receiving portion 19 is provided for holding the terminal retaining member 5 in the provisionally-retained condition and the completely-retained condition relative to the housing 4. The terminal retaining member 5 can be inserted into the terminal retaining member-receiving portion 19. The terminal retaining member-receiving portion 19 is in the form of a recess which is open to the lower surface 18 of the housing 4, and communicates with the terminal receiving holes 17, and extends upwardly to a region near to the upper surface 14 of the housing 4 (However, this receiving portion 19 is not limited to this configuration, and can be formed, for example, into such a configuration that it extends through the upper surface 14.). In the case where the terminal retaining member-receiving portion 19 extends through the upper surface 14, the upper wall of the terminal retaining member 5 is exposed to the exterior through an opening formed in the upper surface 14. The shape of this opening is arbitrary. Incidentally, in the case where the terminal retaining member-receiving portion 19 thus extends through the upper wall 14, the provision of the jig insertion port 22 (described later) can be omitted.

In this embodiment, the terminal retaining member-receiving portion 19 has the plurality of jig insertion ports 21 and the single jig insertion port 22 which are formed through the wall portion thereof and are disposed closer to the upper surface 14 of the housing 4 than the terminal receiving holes 17. A flat surface 23 (see FIG. 11) of this wall portion serves as a stopper portion. The plurality of jig insertion ports 21 extends through the above wall portion of the terminal retaining member-receiving portion 19 in the forward-rearward direction along the jig guide surface 20. The single jig insertion port 22 extends through the upper surface 14 of the housing 4. The stopper portion 23 serves to prevent the movement of the terminal retaining member 5 in a half-inserted condition of the metal terminal 3. Provisionally/completely-retaining ribs 24 (see FIGS. 9 and 10) for holding the terminal retaining member 5 in the provisionally-retained condition and the completely-retained condition are formed at the terminal retaining member-receiving portion 19. The provisionally/completely-retaining ribs 24 are formed respectively on left and right inner side surfaces of the terminal retaining member-receiving portion 19.

In FIG. 1 and FIGS. 4 to 6, the terminal retaining member 5 can be inserted into the terminal retaining member-receiving portion 19 of the housing 4 to retain the metal terminals 3 in a double manner. Like the housing 4, this terminal retaining member 5 is molded of an insulative synthetic resin material. The terminal retaining member 5 has retaining member-side terminal receiving holes 25 formed therethrough in the forward-rearward direction. The retaining member-side terminal receiving holes 25 communicate respectively with the terminal receiving holes 17 of the housing 4 regardless of whether the terminal retaining member 5 is disposed in the provisionally-retained condition or in the completely-retained condition. In this embodiment, there are provided the plurality of (four) retaining member-side terminal receiving holes 25 arranged in a row in the left-right direction. Any two adjacent retaining member-side terminal receiving holes 25 are separated from each other by a partition wall 26. Left and right side walls 27 and 27 of the terminal retaining member 5 serve also as partition walls. Each partition wall 26 as well as each side wall 27 is notched as shown in the drawings, and reference numeral 28 denotes a notched portion.

The terminal primarily-retaining arm 29 of an elastic nature is formed at the upper side of each retaining member-side terminal receiving hole 25. Also, the terminal secondarily-retaining projection 30 is formed at the lower side of each retaining member-side terminal receiving hole 25. The terminal primarily-retaining arm 29 is a cantilever arm extending forwardly from a rear portion of the retaining member-side terminal receiving hole 25 at the upper side thereof, and a distal end portion of this retaining arm 29 projects into the retaining member-side terminal receiving hole 25. The terminal primarily-retaining arm 29 is provided mainly for primarily retaining the metal terminal 3 (The terminal primarily-retaining arm 29 is also used for the secondary retaining of the metal terminal 3.). Although not shown in the drawings, a retaining surface and a tapered surface are formed at the distal end portion of the retaining arm 29. This distal end portion is inserted into the lance hole 12 of the metal terminal 3, and the retaining surface thereof is engaged with an end (edge) portion of the lance hole 12. During the time when the metal terminal 3 passes through the retaining member-side terminal receiving portion 25, the metal terminal 3 is brought into abutting engagement with the tapered surface of the distal end portion of the terminal primarily-retaining arm 29, and presses the tapered surface upwardly, so that the terminal primarily-retaining arm 29 is elastically deformed or bent upwardly.

The retained-condition cancellation projection 31 is formed at the distal end portion of the terminal primarily-retaining arm 29. This retained-condition cancellation projection 31 projects from a side surface of this distal end portion toward a space formed as a result of formation of the notched portion 28. The retained-condition cancellation projection 31 is provided for cancelling the primary retaining of the metal terminal 3 by the terminal primarily-retaining arm 29 with the use of a jig. The retained-condition cancellation projection 31 is formed utilizing the space formed as a result of formation of the notched portion 28, and therefore can be formed without reducing the thickness of the terminal primarily-retaining arm 29, and as a result the above-mentioned retaining surface for retaining the metal terminal 3 can have a sufficient size. The retained-condition cancellation projection 31 has a slanting surface 32 (see FIGS. 12 and 13), and when a rearward force is applied to the slanting surface 32, the terminal primarily-retaining arm 29 is elastically deformed upwardly.

The terminal secondarily-retaining projection 30 at the lower side of the retaining member-side terminal receiving hole 25 is provided for the secondary retaining of the metal terminal 3. More specifically, the terminal secondarily-retaining projection 30 has a retaining surface, and is so shaped as to be engaged with the terminal-side retaining portion 13 of the box-like portion 6 of the metal terminal 3 to thereby prevent the rearward movement of the metal terminal 3 when the terminal retaining member 5 is shifted to the completely-retained condition. The terminal secondarily-retaining projection 30 will not be elastically deformed, and can provide a sufficient retaining force. The terminal secondarily-retaining projection 30 is so formed as not to be engaged with the metal terminal 3 in the provisionally-retained condition of the terminal retaining member 5.

A provisionally-retaining projection 33 and a completely-retaining projection 34 are formed on each of the left and right side walls 27 and 27 of the terminal retaining member 5 (see FIGS. 9 and 10). The provisionally-retaining projection 33 and the completely-retaining projection 34 on each side wall 27 are so formed as to correspond to the corresponding provisionally/completely-retaining rib 24.

Next, the assembling of the connector 1 having the above construction and structure will be described (In other words, the process of retaining the metal terminals 3 in a double manner will be described) with reference to FIGS. 6 to 11.

In FIG. 6, first, the terminal retaining member 5 is fitted into the terminal retaining member-receiving portion 19 of the housing 4 in provisionally-retained relation thereto. When the terminal retaining member 5 is thus disposed in the provisionally-retained condition, the terminal receiving holes 17 of the housing 4 are continuous respectively with the retaining member-side terminal receiving holes 25 of the terminal retaining member 5. At this time, each provisionally/completely-retaining rib 24 of the housing 4 is positioned relative to the corresponding provisionally-retaining projection 33 and completely-retaining projection 34 of the terminal retaining member 5 as shown in FIG. 9.

Then, each metal terminal 3 is inserted into the terminal receiving hole 17 from the rear end of the housing 4. The metal terminal 3, when passing through the retaining member-side terminal receiving hole 25 of the terminal retaining member 5, pushes the terminal primarily-retaining arm 29 of the terminal retaining member 5 upward. When the metal terminal 3 is pushed into the terminal receiving hole 17 until it is brought into abutting engagement with the front end of the terminal receiving hole 17, the distal end portion of the elastically-deformed terminal primarily-retaining arm 29 is disposed in registry with the lance hole 12 of the metal terminal 3, so that the terminal primarily-retaining arm 29 is restored into its initial position to primarily retain the metal terminal 3 as shown in FIG. 7. At this time, the distal end portion of the terminal primarily-retaining arm 29 is inserted in the box-like portion 6 of the metal terminal 3 by an amount h (The amount (depth) h is such that the insertion of the male metal terminal of the mating connector can not be effected.). Thus, the metal terminal 3 is primarily retained by the terminal primarily-retaining arm 29, and is prevented from rearward movement. Because of the configuration of the terminal receiving hole 17 of the housing 4, the metal terminal 3 is also prevented from movement in the forward, upward, downward, left and right directions.

Then, when the terminal retaining member 5 is pushed upward, and is shifted from the provisionally-retained condition to the completely-retained condition as shown in FIG. 8, only the terminal retaining member 5 is moved while the metal terminals 3 remain as they are. At this time, the amount of engagement of the primarily-retained portion of each metal terminal 3 with the retaining arm 29 is reduced, whereas the terminal secondarily-retaining projection 30 of the terminal retaining member 5 is engaged with the metal terminal 3 in accordance with the upward movement of the terminal retaining member 5, so that the necessary and sufficient retaining force is secured. The metal terminals 3 are retained in a double manner by the terminal retaining member 5 held in the completely-retained condition relative to the housing 4, and are prevented from withdrawal from the housing 4. In the completely-retained condition of the terminal retaining member 5, each provisionally/completely-retaining rib 24 of the housing 4 is positioned relative to the corresponding provisionally-retaining projection 33 and completely-retaining projection 34 of the terminal retaining member 5 as shown in FIG. 10. Thus, the assembling of the connector 1 is completed.

Each terminal receiving hole 17 of the housing 4 is so formed as to prevent the metal terminal 3 from movement in the upward and downward directions as described above, and therefore even when trying to shift the terminal retaining member 5 from the provisionally-retained condition into the completely-retained condition in a half-fitted condition of the metal terminal 3 as shown in FIG. 11, the terminal secondarily-retaining projection 30 abuts against the lower wall of the box-like portion 6 of the metal terminal 3, so that the terminal retaining member 5 is prevented from being pushed up. Because of the fact that the pushing-up of the terminal retaining member 5 is thus prevented, the half-fitted condition of the metal terminal 3 can be detected.

With respect to the detection of the half-fitted condition of the metal terminal 3, in the half-fitted condition of the metal terminal 3, the terminal primarily-retaining arm 29 of the terminal retaining member 5 is disposed on the box-like portion 6 of the metal terminal 3, and is elastically deformed. In the half-fitted condition of the metal terminal 3 as shown in FIG. 11, even when trying to shift the terminal retaining member 5 from the provisionally-retained condition into the completely-retained condition in an elastically-deformed condition of the terminal primarily-retaining arm 29, the terminal primarily-retaining arm 29 abuts against the stopper portion 23 of the housing 4, so that the terminal retaining member 5 is prevented from being pushed up. In this case, also, the half-fitted condition of the metal terminal 3 can be detected.

As will be appreciated from the above structure, the connector 1 of the present invention achieves an advantage that the efficiency of the assembling operation, etc., can be enhanced as compared with conventional connectors. Further, the connector 1 of the invention achieves advantages that the compacter design can be achieved as compared with the conventional connectors, that the sufficient retaining force can be secured and that the half-fitted condition of the metal terminal can be detected.

Next, the cancellation of the primary retaining of the metal terminal 3 will be described with reference to FIGS. 12 and 13, and thereafter the cancellation of the retained condition of the terminal retaining member 5 will be described with reference to FIG. 14.

In FIG. 12, the retained-condition cancellation projection 31 (painted in black) is formed on the terminal primarily-retaining arm 29 of the terminal retaining member 5 as described above. This retained-condition cancellation projection 31 is formed at such a position as not to interfere with the metal terminal 3 when the metal terminal 3 inserted into the terminal receiving hole 17 from the rear end of the housing 4 passes through the retaining member-side terminal receiving hole 25 of the terminal retaining member 5. The retained-condition cancellation projection 31 is disposed in facing relation to the corresponding jig insertion port 21 of the housing 4, and when the retained-condition cancellation jig 35 is moved rearward along the jig guide surface 20 as shown in FIG. 13, the terminal primarily-retaining arm 29 is pressed by this retained-condition cancellation jig 35, and is elastically deformed upwardly, so that its primarily-retaining engagement with the metal terminal 3 is easily cancelled (Namely, the primary retaining can be cancelled merely by inserting the retained-condition cancellation jig 35.).

In FIG. 14, the retained-condition cancellation jig 35 is inserted into the jig insertion port 22 formed in the upper surface 14 of the housing 4 of the connector 1, and this retained-condition cancellation jig 35 is pushed in a direction of an arrow (in FIG. 14) or downwardly, so that the terminal retaining member 5 disposed in the completely-retained condition is shifted to the provisionally-retained condition. After the terminal retaining member 5 is thus shifted to the provisionally-retained condition, the primary retaining of the metal terminal 3 can be cancelled by elastically deforming the terminal primarily-retaining arm 29 with the use of the retained-condition cancellation jig 35 as shown in FIG. 13.

As described above, the connector 1 of the invention has the useful structure for enabling only the necessary metal terminal 3 to be easily removed. Therefore, there is achieved an advantage that the efficiency of the maintenance operation is enhanced as compared with the conventional connectors.

The present invention is not limited to the above embodiment, and various modifications can be made without departing from the subject matter of the invention.

What is claimed is:

1. A connector, comprising:

a female metal terminal having a box-like portion;

a housing including a terminal receiving hole and a terminal retaining member-receiving portion; and a terminal retaining member which can be provisionally and completely retained in said terminal retaining member-receiving portion;

wherein said box-like portion of said metal terminal has a lance hole formed in a wall thereof opposed to an upper surface of said terminal receiving hole, and an end portion of said box-like portion including a rear end of a wall thereof opposed to a lower surface of said terminal receiving hole serves as a terminal-side retaining portion; and said terminal receiving hole of said housing extends from a rear end of said housing toward a front end of said housing, and is so sized as to prevent said metal terminal received in said terminal receiving hole from moving in forward, upward, downward, left and right directions; and said terminal retaining member-receiving portion of said housing is open to a lower surface of said housing, and communicates with said terminal receiving hole, and extends to the vicinity of an upper surface of said housing or extends through said upper surface of said housing; and said terminal retaining member includes a retaining member-side terminal receiving hole formed therethrough in the forward-rearward direction and communicating with said terminal receiving hole, a terminal primarily-retaining arm of an elastic nature formed at an upper side of said retaining member-side terminal receiving hole, and a terminal secondarily-retaining projection formed at a lower side of said retaining member-side terminal receiving hole; and when said terminal retaining member is disposed in the provisionally-retained condition relative to said housing, a retaining portion of said terminal primarily-retaining arm of said terminal retaining member is inserted deep in said lance hole of said metal terminal;

when said terminal retaining member is moved upward into the completely-retained condition relative to said housing, the amount of engagement of said retaining portion of said terminal primarily-retaining arm with said metal terminal is reduced in accordance with the upward movement of said terminal retaining member, whereas said terminal secondarily-retaining projection is engaged with said terminal-side retaining portion of said metal terminal; and when trying to shift said terminal retaining member into said completely-retained condition in a half-inserted condition of said metal terminal, said terminal secondarily-retaining projection of said terminal retaining member abuts against the wall of said box-like portion of said metal terminal, thereby preventing the upward movement of said terminal retaining member.

2. The connector according to claim 1, wherein the half-inserted condition of said metal terminal, said terminal primarily-retaining arm of said terminal retaining member is disposed on said box-like portion of said metal terminal, and is elastically deformed, and in this condition, when trying to shift said terminal retaining member into said completely-retained condition, said terminal primarily-retaining arm abuts against a stopper portion of said housing, thereby preventing the upward movement of said terminal retaining member.

3. The connector according to claim 1, wherein said housing has a jig insertion port communicating with that portion of said terminal retaining member-receiving portion which is disposed closer to the upper surface of said housing than said terminal receiving hole, and when said terminal primarily-retaining arm of said terminal retaining member is pressed by a retained-condition cancellation jig inserted in said jig insertion port, said retaining arm is elastically deformed upwardly, and is brought out of retaining engagement with said metal terminal in the provisionally-retained condition of said terminal retaining member.

4. The connector according to claim 1, wherein said terminal retaining member has a partition wall so formed as to correspond to said terminal receiving hole of said housing, and said terminal primarily-retaining arm has a retained-condition cancellation projection which projects into a space formed as a result of formation of a notched portion in said partition wall.

5. The connector according to claim 4, wherein said retained-condition cancellation projection has a slanting surface, and when a rearward force is applied to said slanting surface, said terminal primarily-retaining arm is elastically deformed upwardly.

* * * * *